US009097129B2

(12) United States Patent
Aiello et al.

(10) Patent No.: US 9,097,129 B2
(45) Date of Patent: Aug. 4, 2015

(54) SEGMENTED SEAL WITH SHIP LAP ENDS

(75) Inventors: Nicholas Aiello, New Haven, CT (US); Conor Lee, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 47 days.

(21) Appl. No.: 13/484,762

(22) Filed: May 31, 2012

(65) Prior Publication Data

US 2013/0323029 A1 Dec. 5, 2013

(51) Int. Cl.
*F01D 11/00* (2006.01)
*F04D 29/08* (2006.01)

(52) U.S. Cl.
CPC ..... *F01D 11/001* (2013.01); *F04D 29/083* (2013.01); *Y10T 29/49321* (2015.01)

(58) Field of Classification Search
USPC ..... 277/411, 412, 415, 418, 419, 421; 415/173.4, 173.5, 174.4, 174.5
See application file for complete search history.

(56) References Cited

U.S. PATENT DOCUMENTS 1,356,393 A * 10/1920 Nolte ..... 277/529
3,124,502 A * 3/1964 Radke ..... 428/66.4
3,337,224 A 8/1967 Eser et al.
4,554,748 A 11/1985 Nixon
4,630,994 A 12/1986 Gross
4,862,949 A 9/1989 Bell
4,884,590 A 12/1989 Eber et al.
5,211,407 A 5/1993 Glynn et al.
5,609,469 A 3/1997 Worley et al.
6,036,191 A * 3/2000 Millard ..... 277/553
6,237,921 B1 5/2001 Liotta et al.
6,352,267 B1 3/2002 Rode
6,368,054 B1 4/2002 Lucas
6,439,844 B1 8/2002 Turnquist et al.
6,609,885 B2 8/2003 Mohammed-Fakir et al.
7,371,044 B2 5/2008 Nereim
7,413,194 B2 8/2008 Wright et al.
7,458,584 B2 12/2008 Addis
7,470,113 B2 * 12/2008 Tran et al. ..... 416/198 A
8,038,399 B1 10/2011 Liang
8,313,289 B2 * 11/2012 Caprario et al. ..... 415/173.7
2006/0275106 A1 12/2006 Alvanos et al.
2008/0112811 A1 5/2008 Erickson et al.
2008/0309019 A1 * 12/2008 Wolfe et al. ..... 277/420
2009/0148277 A1 6/2009 Tholen et al.
2009/0148295 A1 * 6/2009 Caprario et al. ..... 416/193 A
2009/0238683 A1 * 9/2009 Alvanos et al. ..... 415/173.7
2010/0284797 A1 * 11/2010 Jarrabet et al. ..... 415/174.4
2010/0290898 A1 11/2010 McCaffrey
2011/0299978 A1 12/2011 Afanasiev et al.
2011/0305561 A1 * 12/2011 Afanasiev et al. ..... 415/180
2012/0301306 A1 * 11/2012 Alvanos et al. ..... 416/204 R
2013/0017095 A1 * 1/2013 Lee et al. ..... 416/239

FOREIGN PATENT DOCUMENTS

WO WO 0248508 A2 6/2002
WO WO 2008143634 A2 11/2008

OTHER PUBLICATIONS

Internation Search Report and Written Opinion, dated Sep. 27, 2013, PCT Application No. PCT/US2013/039643, 13 pages.

* cited by examiner

*Primary Examiner* — Kristina Fulton
*Assistant Examiner* — L. Susmitha Koneru
(74) *Attorney, Agent, or Firm* — Kinney & Lange, P.A.

(57) ABSTRACT

A segment for a knife edge seal includes an arcuate segment with a first end with a first end surface and a second end with a second end surface. The first end surface and the second end surface are complementary and overlapping when the first end surface and the second end surface interface with ends of adjacent segments.

13 Claims, 4 Drawing Sheets

SEGMENTED SEAL WITH SHIP LAP ENDS

BACKGROUND

Knife edge seals are used in most rotors of a gas turbine engine to prevent gas from leaking around rotors and blades. Knife edge seals are particularly used in very hot areas, such as the high pressure compressor and high pressure turbine. A typical knife edge seal is a full hoop with a portion attaching to a rotor or blade and a knife edge which contacts another rotor, blade, casing or other part to prevent leakage.

SUMMARY

A segment for a knife edge seal includes an arcuate segment with a first end with a first end surface and a second end with a second end surface. The first end surface and the second end surface are complementary and overlapping when the first end surface and the second end surface interface with ends of adjacent segments.

A method of forming a segmented seal with ship lap ends includes obtaining a plurality of oversized arcuate seal segments, each segment with a first end and a second end with a second mating surface; machining the first end of each segment to form a first mating surface; machining the second end of each segment to form a second mating surface, wherein the first mating surface is complementary and overlapping to the second mating surface when a first end of a seal segment is interfaced with a second end of another adjacent seal segment; and fitting the segments together to form a full circumferential segmented seal, wherein the segments are fit together with a first mating surface of one segment connecting to a second mating surface of an adjacent segment.

BRIEF DESCRIPTION OF THE DRAWINGS

FIG. 3B shows the connection between two seal segments of FIG. 3A, with a second seal segment shown as see through.

FIG. 3C shows the connection between two seal segments of FIG. 3A, with a first seal segment shown as see through.

DETAILED DESCRIPTION

Figure 1A:
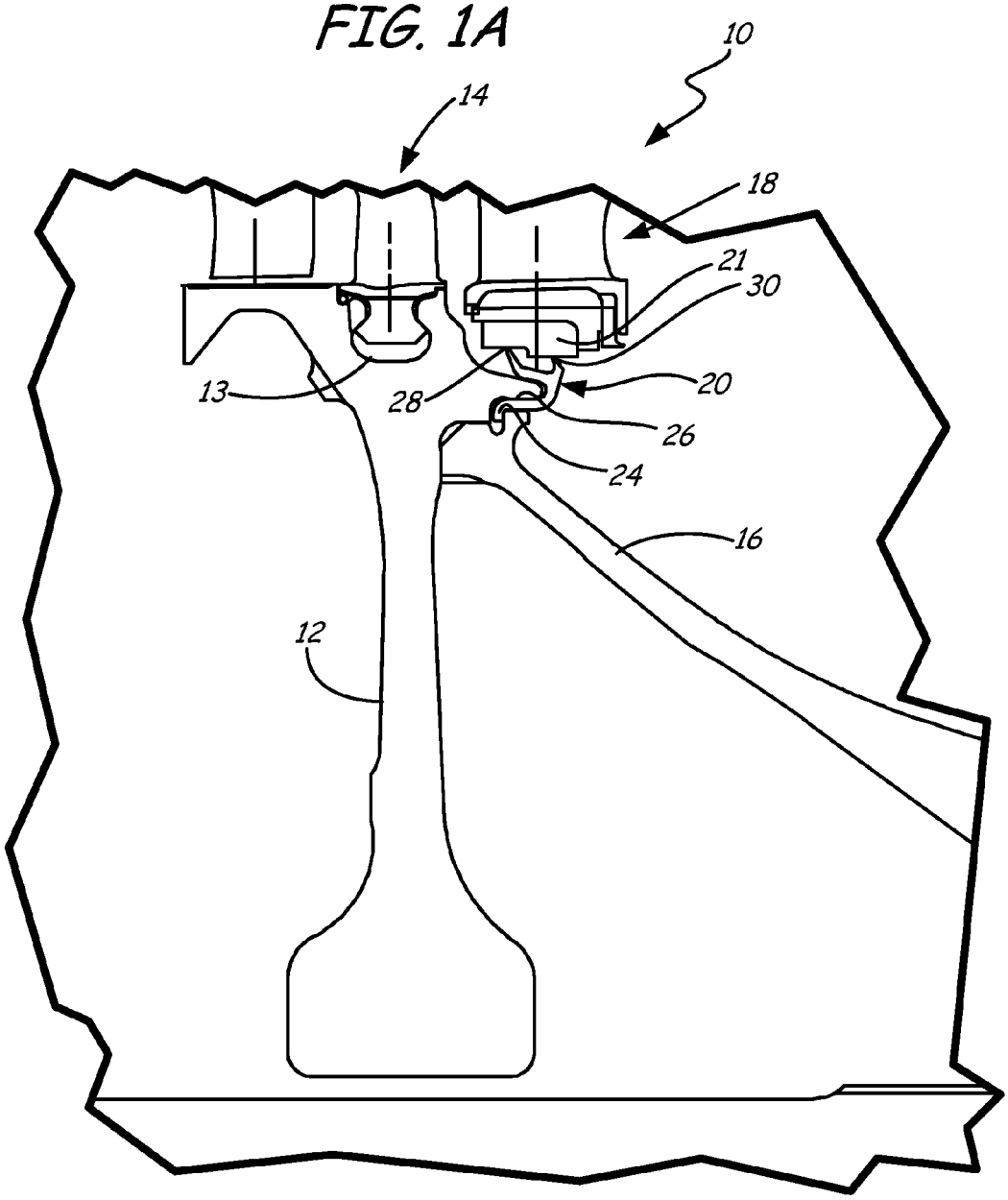
FIG. 1A is a cross-sectional view of a portion of a high pressure compressor.
Figure 1B:
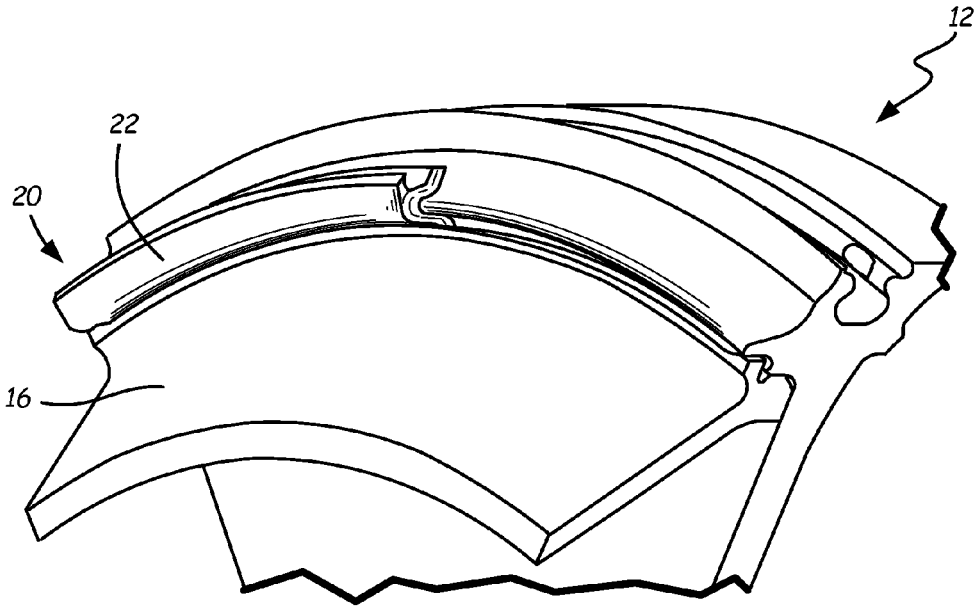
FIG. 1B is a perspective view of the hub, disk and a seal segment of FIG. 1A.

FIG. 1A is a cross-sectional view of a portion of a high pressure compressor 10, and FIG. 1B shows a perspective view of a portion of disk 12, rear hub 16 and knife edge seal 20 of FIG. 1A. The portion of high pressure compressor 10 shown includes rotor disk 12 with slot 13, blade 14, rear hub 16, outlet guide vane 18 and knife edge seal 20. Knife edge seal 20 is formed of a plurality of arcuate segments 22, each including retention tang 24, load bearing surface 26, first knife edge 28, second knife edge 30, first end 32 and second end 34.

Blade 14 connects to disk 12 at slot 13 to move with disk. Rear hub 16 connects to disk 12 to move with disk 12 as well. Knife edge seal 20 connects to rear hub 16 and disk 12 by retention tang 24.

Disk 12, blade 14, rear hub 16 and knife edge seal 20 rotate together to move air through compressor section 10, compressing the air. Knife edge seal 20 contacts and can slice into abradable material 21 to form a seal between rotating parts (disk 12 and rear hub 16) and stationary parts (outlet guide vane 18). This ensures most air flows through compressor 10 flows through exit guide vane 18 and not down near rear hub 16. This increases efficiency by keeping compressed air in the primary flowpath.

Knife edge seal 20 is made of a plurality of arcuate segments 22 to form a full circumferential segmented seal (see FIG. 3A) between rotating and non-rotating components. Segments 22 are generally shaped the same, with a first end 32 that is overlapping and complementary to second end 34 when connected. When an engine is in operation, disk 12, blade 14, rear hub 16 and knife edge seal 20 are rotating and centrifugal force acts on knife edge seal segments 22, pushing them away from each other. By making ends 32, 34 of segments 22 overlapping and complementary, knife edge seal 20 leakage is minimized or prevented between seal segments during all engine conditions.

Figure 2A:
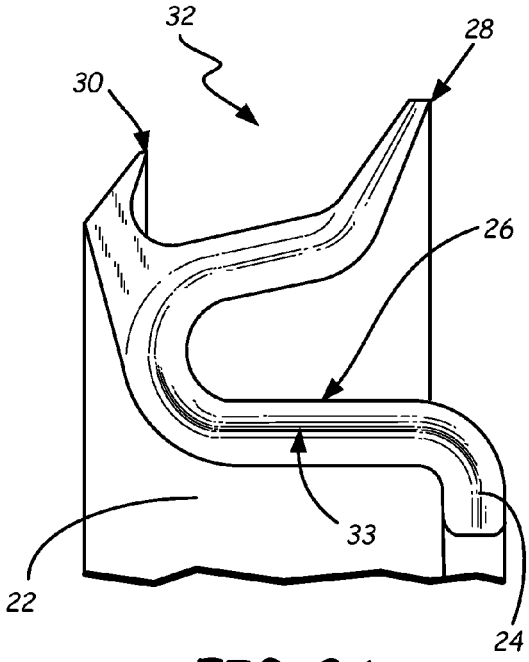
FIG. 2A is a perspective view of a first end of a seal segment.
Figure 2B:
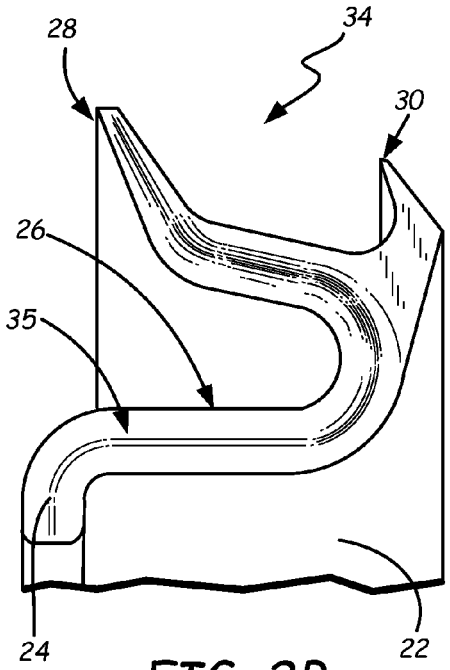
FIG. 2B is a perspective view of a second end of a seal segment.

FIG. 2A is a perspective view of first end 32 of seal segment 22, and FIG. 2B is a perspective view of second end 34 of a seal segment 22. Seal segment 22 includes retention tang 24, load bearing surface 26, first knife edge 28, second knife edge 30, first end 32 and second end 34. Seal segments 22 are generally one monolithic part and can be made of nickel (including alloys) or other materials depending on system requirements, including, but not limited to weight and operating temperatures.

Seal segments 22 can be formed by obtaining a plurality of oversized seal segments. The segments must be oversized initially to be able to mill, or otherwise machine them down on first end 32 and second end 34 and once machined, be able to form a complete circle with all segments 22. A path to form the ship lap seal through the segment 22 cross section must be chosen. This can be selected by separating the cross-section into halves, for example, an inner portion and an outer portion or an upper portion and a lower portion. The shiplap seal must form a path through the entire cross section of the seal 20 to be able to prevent leakage. First end 32 is then machined down to form one half of the seal with a first mating surface 33. Next, second end 34 is machined down to form a complementary other half of the seal with a second mating surface 35. Seal segments 22 can then fit together, with first mating surface 33 connecting to by facing or butting up against second mating surface 35 of adjacent seal segments 22 to form a full circumferential segmented knife edge seal 20.

In the example shown in FIGS. 2A-2B, outer half of first end 32 is machined down so that inner half extends further circumferentially. Inner half of second end 34 is machined down so that outer half extends further circumferentially to form complementary shapes. In the example shown, first end 32 is convex on inner half and second end 34 is concave on inner half. This enables segments 22 to fit together, first end 32 to second end 34 and form an overlapping ship lap seal between adjacent segments 22.

Because knife edges 28, 30 are very thin on knife edge seals 20, manufacturing seal segments 20 can involve initially forming the knife edge which the shiplap seal will go through (in this example, first knife edge 28) wider than desired. Ends 32, 34 can then be machined down to form complementary overlapping ends between segments 22.

Figure 3A:
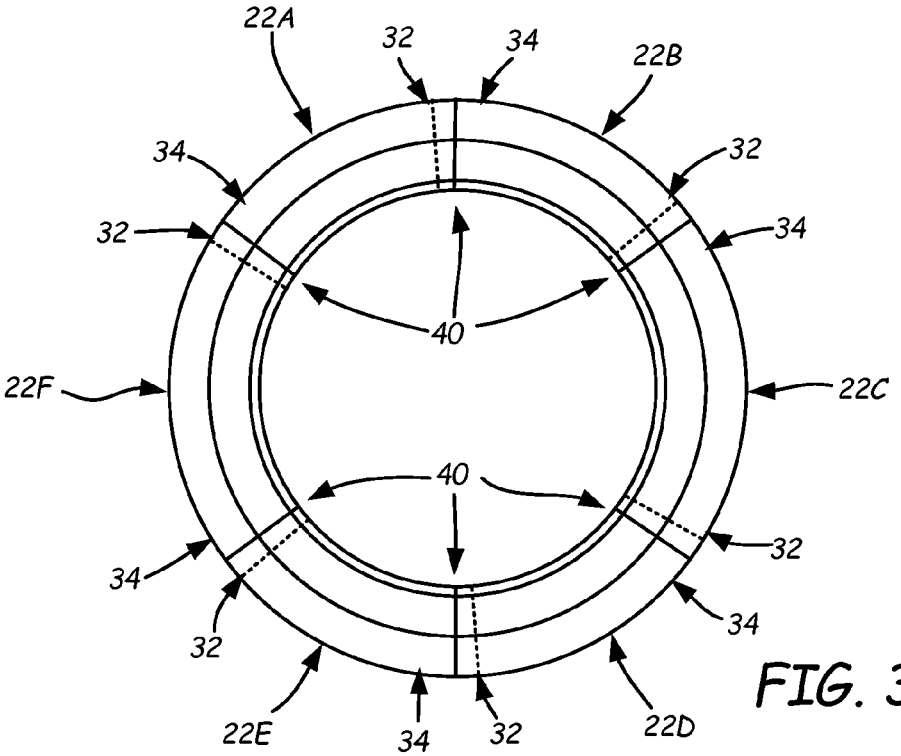
FIG. 3A shows a perspective view of seal segments arranged to form a full circumferential segmented seal.
Figure 3B:
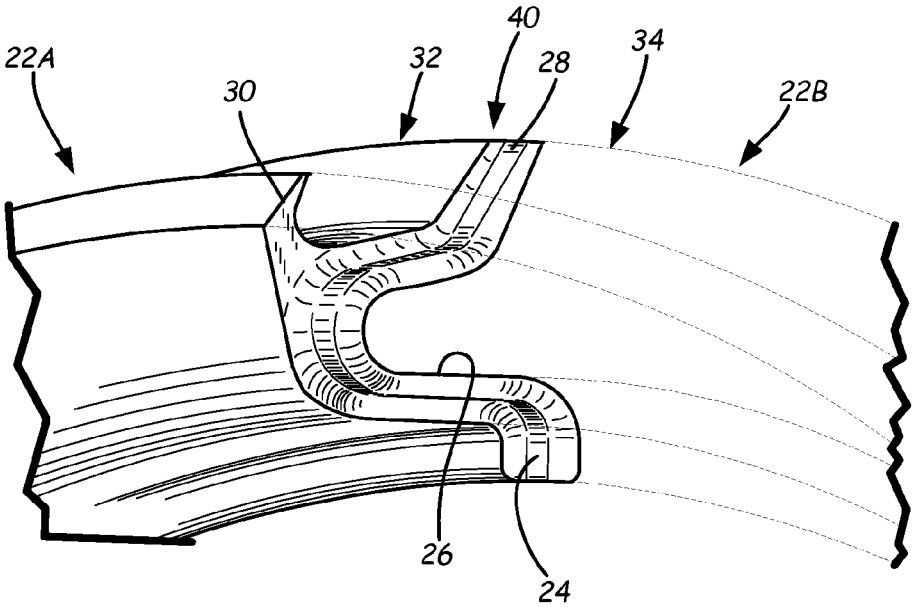
Figure 3C:
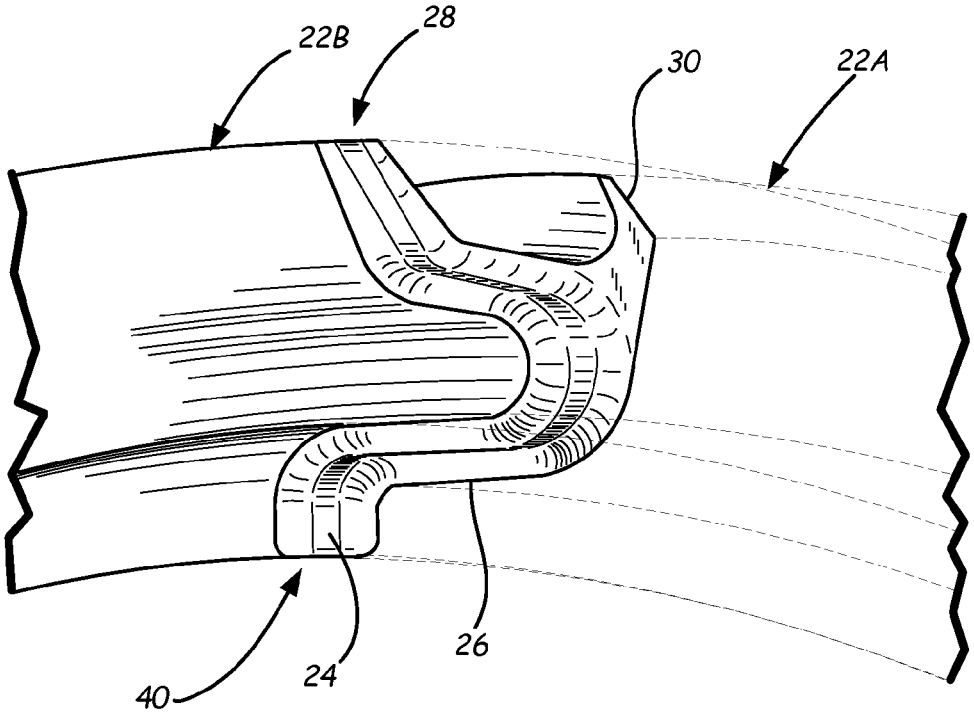

FIG. 3A shows a full knife edge seal 20. FIG. 3B shows an interface between two seal segments 22A and 22B, with seal segment 22B shown as see through, and FIG. 3C shows FIG. 3B with a first seal segment 22A shown as see through. Full knife edge seal 20 is made of six segments 22A, 22B, 22C, 22D, 22E and 22F, with a ship lap seal 40 between each. Knife edge seal 20 includes first seal segment 22A and second seal segment 22B with shiplap seal 40, each segment 22A, 22B with retention tang 24, load bearing surface 26, first knife edge 28, second knife edge 30, first end 32 and second end 34. While six seal segments are shown, knife edge seal 20 could be formed by more or fewer segments in other embodiments to form a complete circumferential segmented knife edge seal 20.

First end 32 of first seal segment 22A fits complementary and overlapping with second end 34 of second seal segment 22B. While only one shiplap seal 40 between segments 22A, 22B is shown, each shiplap seal 40 between adjacent seal segments in knife edge seal 20 includes a first end 32 which is complementary and overlapping to a second end 34.

Knife edge seal 20 is formed by segments 22A-22F. By forming ends 32, 34 of each segment 22 to be overlapping and complementary, knife edge seal 20 is able to prevent leakage between seal segments 22, making the seal more effective even during engine operating conditions when centrifugal force pushes seal segments 22 outward and away from each other. By overlapping to prevent leakage between segments 22, seal 20 can protect engine parts and promote engine efficiency by directing air flow properly.

While a portion of high pressure compressor 10 is shown, knife edge seal 20 can be used in many other parts that need a seal between rotating parts and non-rotating parts, including, but not limited to the high pressure turbine and the low pressure compressor. While segmented seal 20 shown includes two knife edges 28, 30, other seals can contain more or fewer knife edges and can take a different path through the cross-section for the overlapping portions.

While knife edge seal 20 has been discussed in relation to being formed of segments 22, each with a first end and a second end that are overlapping and complementary, segment ends could be varied so long as the connection between two adjacent segments is complementary and overlapping.

A segment for a knife edge seal includes an arcuate segment with a first end with a first end surface and a second end with a second end surface; wherein the first end surface and the second end surface are complementary and overlapping when the first end surface and the second end surface interface with ends of adjacent segments.

Additional and/or alternative embodiments include the first end surface and the second end surface having a convex portion and a concave portion; the transition between the convex portion and concave portion going through the knife edge of the seal; the segment comprising a retention tang to hold the seal in place, a knife edge, and a main load bearing surface to connect the retention tang and the knife edge; the transition between the convex and concave portion going through the tang, the main load bearing surface and the knife edge; the overlap being 10% of the seal length; the seal being made of nickel; and/or the segment fitting end to end with one or more other segments to form a full circumferential segmented knife edge seal.

A segmented knife edge seal includes a plurality of knife edge seal segments, wherein the segments fit together to form a full segmented circle. Each segment comprises a knife edge; a first end; and a second end, wherein the first end and the second end are complementary so that the end of each segment mates with the second end of an adjacent segment to overlap and form a ship lap seal between adjacent segments.

Additional and/or alternative embodiments include the first end of each segment extending circumferentially further on a top half of the segment than a bottom half; the second end of each segment extending circumferentially further on a bottom half of the segment; the ship lap seal extending through the knife edge; the segments being nickel, the segments overlapping each other 20% of the length, each segment further comprising a retention tang to hold the seal in place with respect to another part and a main load bearing surface to connect the retention tang to the knife edge; and/or the ship lap seal going through the retention tang, the main load bearing surface and the knife edge.

A method of forming a segmented seal with ship lap ends includes obtaining a plurality of oversized arcuate seal segments, each segment with a first end and a second end with a second mating surface; machining the first end of each segment to form a first mating surface; machining the second end of each segment to form a second mating surface, wherein the first mating surface is complementary and overlapping to the second mating surface when a first end of a seal segment is interfaced with a second end of another adjacent seal segment; and fitting the segments together to form a full circumferential segmented seal, wherein the segments are fit together with a first mating surface of one segment connecting to a second mating surface of an adjacent segment.

Additional and/or alternative embodiments include the step of machining the first end and second end of each seal segment so that it is complementary and overlapping when a first end of a seal segment is connected to a second end of another adjacent seal segment comprising machining the first end of each segment so that an outer portion of the first end extends further circumferentially than an inner portion and machining the second end of each segment so that an inner portion of the second end extends further circumferentially than an outer portion, wherein after machining, the first end of each segment fits together with the second end of any segment to form a ship lap seal between segments; the seal being a knife edge seal and the machining being performed on the first end and second end so that the ship lap seal extends through the knife edge seal.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

What is claimed is:

1. A method of forming a segmented knife edge seal with ship lap ends, the method comprising:

obtaining a plurality of oversized arcuate seal segments, each segment with a first end, a second end, a retention tang to hold the seal in place with respect to another part, and a main load bearing surface to connect the retention tang to the knife edge seal, the first and second ends spaced apart in a circumferential direction;

machining the first end of each segment to form a first mating surface for a ship lap seal, wherein machining is performed on the first end so that the ship lap seal extends through the knife edge seal, and wherein the first end has a convex portion and a concave portion;

machining the second end of each segment to form a second mating surface for another ship lap seal, wherein machining is performed on the second end so that the other ship lap seal extends through the knife edge seal, wherein the first mating surface is complementary and overlapping to the second mating surface when a first end of a seal segment is interfaced with a second end of another adjacent seal segment, and wherein the second end has a convex portion and a concave portion, the respective concave and convex portions of the first and second ends defining the complementary ship lap mating surfaces; and fitting the segments together to form a full circumferential segmented seal, wherein the segments are fit together with the first mating surface of one segment connecting to the second mating surface of an adjacent segment.

2. The method of claim 1, wherein the step of machining the first end and second end of each seal segment so that it is complementary and overlapping when a first end of a seal segment is connected to a second end of another adjacent seal segment comprises:

machining the first end of each segment so that an outer portion of the first end extends further circumferentially than an inner portion; and machining the second end of each segment so that an inner portion of the second end extends further circumferentially than an outer portion, wherein after machining, the first end of each segment fits together with the second end of any segment to form a ship lap seal between segments.

3. A segment for a knife edge seal comprising:

an arcuate segment defining a portion of a circle, the arcuate segment having a first end with a first end surface, a second end with a second end surface, a retention tang to hold the seal in place, and a main load bearing surface to connect the retention tang and the knife edge; wherein the first end surface and the second end surface are circumferentially spaced from each other, and wherein the first end surface and the second end surface each define a rabbeted ship lap mating surface that goes through a knife edge of the seal, wherein both the first end surface and the second end surface have a convex portion and a concave portion, which define the respective rabbeted ship lap mating surfaces.

4. The segment of claim 3, wherein a transition between the convex and the concave portion goes through the tang and the main load bearing surface.

5. The segmented seal of claim 3, wherein the rabbeted ship lap mating surface of the both the first and second ends defines an overlap that is 10% of the seal length.

6. The segmented seal of claim 3, wherein the seal is made of nickel.

7. The segmented seal of claim 3, wherein the segment fits end to end with one or more other segments to form a full circumferential segmented knife edge seal.

8. A segmented knife edge seal comprising:

a plurality of knife edge seal segments, wherein the segments fit together to form a full segmented circle, each segment comprising:

a knife edge;

a retention tang to hold the seal in place with respect to another part;

a main load bearing surface to connect the retention tang to the knife edge;

a first end; and a second end circumferentially spaced from the first end, wherein the first end and the second end are complementary so that the first end of each segment mates with the second end of an adjacent segment to overlap and form a ship lap seal between adjacent segments, wherein the ship lap seal extends through the knife edge, and wherein both the first end and the second end have a convex portion and a concave portion, which define the complementary ship lap mating surfaces of the first and second ends.

9. The segmented knife edge seal of claim 8, wherein the first end of each segment extends circumferentially further on a top half of the segment than a bottom half.

10. The segmented knife edge seal of claim 9, wherein the second end of each segment extends circumferentially further on a bottom half of the segment.

11. The segmented knife edge seal of claim 8, wherein the segments are nickel.

12. The segmented knife edge seal of claim 8, wherein the segments overlap each other about 20% of each segment length.

13. The segmented knife edge seal of claim 8, wherein the ship lap seal goes through the retention tang and the main load bearing surface.

* * * * *